United States Patent [19]

Ahlström

[11] Patent Number: 4,974,747

[45] Date of Patent: Dec. 4, 1990

[54] VENDING MACHINE FOR COMPLETE MEALS

[76] Inventor: Allan Ahlström, Box 49, S-310 38 Simlångsdalen, Sweden

[21] Appl. No.: 286,988

[22] Filed: Dec. 20, 1988

[30] Foreign Application Priority Data

Dec. 28, 1987 [SE] Sweden ..... 8705157

[51] Int. Cl.[5] ..... G07F 11/62

[52] U.S. Cl. ..... 221/87; 221/94

[58] Field of Search ..... 221/87, 88, 89, 90, 221/93, 94, 126, 127, 130

[56] References Cited

U.S. PATENT DOCUMENTS

| | | | |
|---|---|---|---|
| 983,045 | 1/1911 | Gossman et al. | 221/126 |
| 1,009,265 | 11/1911 | Stern et al. | 221/126 |
| 1,053,187 | 2/1913 | Lissauer | 221/126 |
| 1,121,804 | 12/1914 | Coulson | 221/93 |

*Primary Examiner*—F. J. Bartuska

[57] ABSTRACT

A vending machine which, after payment of a fee, delivers a complete meal from a number of meals which are available through the manipulation of a selector member. Each of the meals comprises two or more articles of food packaged in separate units. The units are stored in different compartments in the machine. The compartments are placed on different levels within the machine. The selector member comprises a traveller which can be displaced along a U-shaped arm which is journalled on a horizontal axis so it can be pivoted by drive motor, until the traveller is in a position to cooperate with one of several elevator frames. These frames are coaxially journalled, and has linkage arms for mechanical connection to different feeding out devices which are arranged at each respective compartment level.

4 Claims, 2 Drawing Sheets

VENDING MACHINE FOR COMPLETE MEALS

FIELD OF THE INVENTION

The present invention relates to a vending machine which, after payment of a fee, delivers a complete meal from a number of meals which are available through the manipulation of selection means, each of said meals comprising two or more articles of food packaged in separate units, which units are stored in different compartments in said machine.

BACKGROUND OF THE INVENTION

Vending machines of the kind described above are used for providing portion-packed food, e.g. at working places with shift working. Usually a micro-wave oven is used for heating of the articles of food which are provided by the vending machine. The articles of food may be stored in a frozen state within the vending machine, or they may be packaged in a heat stabilized state, according to a known method, so that they may be stored for a long time in room temperature without deterioration.

Regardless of the storing method, the articles of food in a meal normally are packed separately, so that e.g. meat, potatoes and vegetables are packed in three segregated units. It would be possible to store these three units together in one container, so that the purchaser by paying a fee, e.g. a token, directly can get a complete meal of a desired kind. However, the use of these containers complicate loading of the vending machine and results in increased costs. Further, there is demand for reduction of the time for the feeding out process.

SUMMARY OF THE INVENTION

The object of the present invention is to provide a vending machine which enables synchronous feeding out of a number of packages which are stored in separate compartments, and together form a complete meal.

For realizing this object, the compartments are placed on different levels within the machine, the selector means comprises a traveller which can be displaced along a U-shaped arm which is journalled on a horizontal axis so it can be pivoted by drive means until said traveller is in a position to cooperate with one of several elevator frames which are coaxially journalled, and said elevator frames having means for mechanical connection to different feeding out means which are arranged at each respective compartment level.

According to one preferable embodiment of the invention, each elevator frame is connected in parallel via a linkage to at least one feeding out means.

According to another embodiment of the invention, it preferably comprises four side walls, together with a back side wall forming a vertical closet surrounding said compartments, wherein the interior of said closet may be closed off by a closet door which is pivotally hinged at one of the side walls, and that the U-shaped arm and the elevator frames are pivotally journalled between the two vertical side walls.

Further according to the invention, the drive means may be placed in an enclosed space at the outside of the closet and projects into the closet by means of a drive shaft, and said shaft may be provided with a crankshaft which is arranged to cooperate with the U-shaped arm during a feeding out process.

Other characteristics of the invention will be clear from the accompanying claims.

BRIEF DESCRIPTION OF THE DRAWINGS

One embodiment of the invention will now be described in more detail, with reference to the accompanying drawings, in which FIG. 1 schematically shows the arrangement of goods compartments in the vending machine, and their cooperation with the feeding out means.

DESCRIPTION OF A PREFERRED EMBODIMENT

Figure 1:
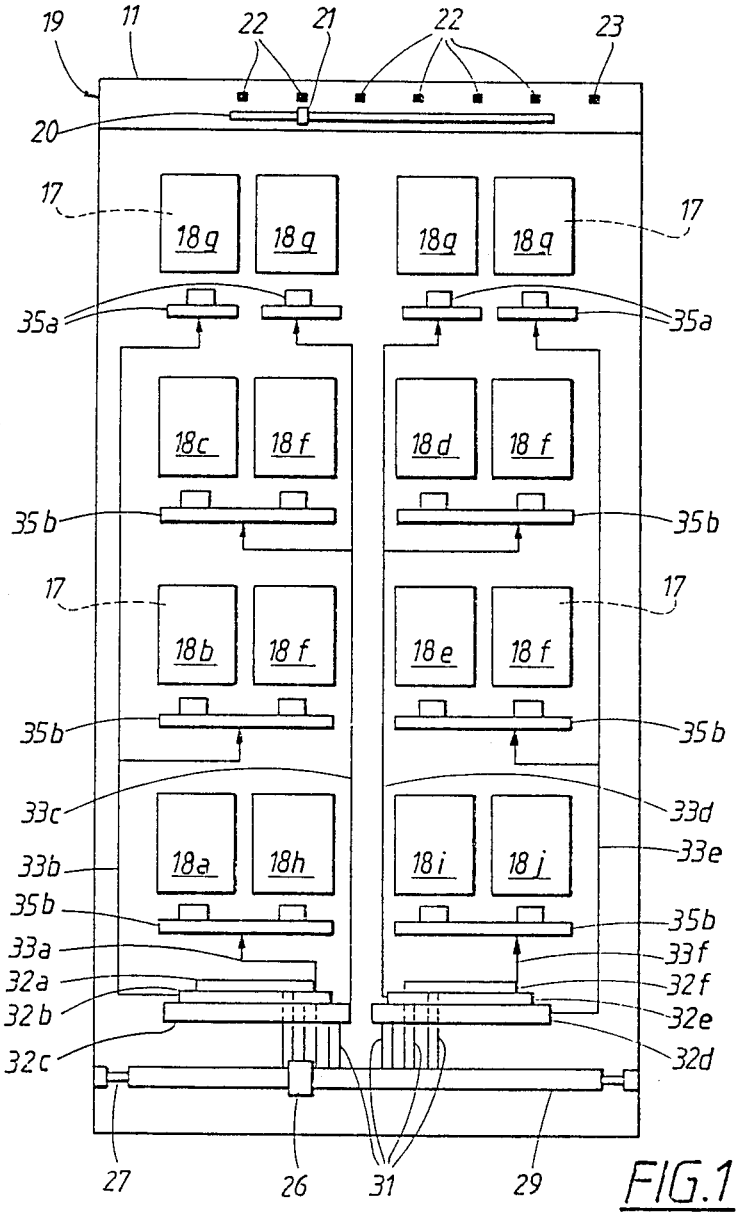

The vending machine shown in the drawings comprises four side walls 10–13, which together with a rear side wall 14 forms a vertical closet 15 which can be closed off by a closet door 16 which is pivotally hinged at one of the side walls 13.

The closet 15 contains sixteen compartments 17, which are inclined downward in the direction of the closet opening and are distributed horizontally and vertically on four levels in the closet. Each compartment contains packages **18*a*–18*j* with a certain type of article of food, e.g. meat 18*a*–18*d*, fish 18*e*, potatoes 18*f*, mashed turnips 18*h*, pea soup 18*i* and pancakes with jam 18*j***. In this embodiment, these packages enables the choice of six different meals, of which four comprise meat or fish with potatoes and vegetables, i.e. each with three different packages, and the remaining two meals comprising, e.g. mashed turnips with pork and pea soup with pancakes, i.e. each with two different packages.

Any one of these six meals can be selected by means of a selector means 19 which is arranged at the top of the closet. Said selector means comprise a control arm 21 which projects through a slit 20, said arm can be displace sideways to any one of six positions 22. An indicator lamp 23 is also provided, for indication that the arm is in correct position.

Figure 2:
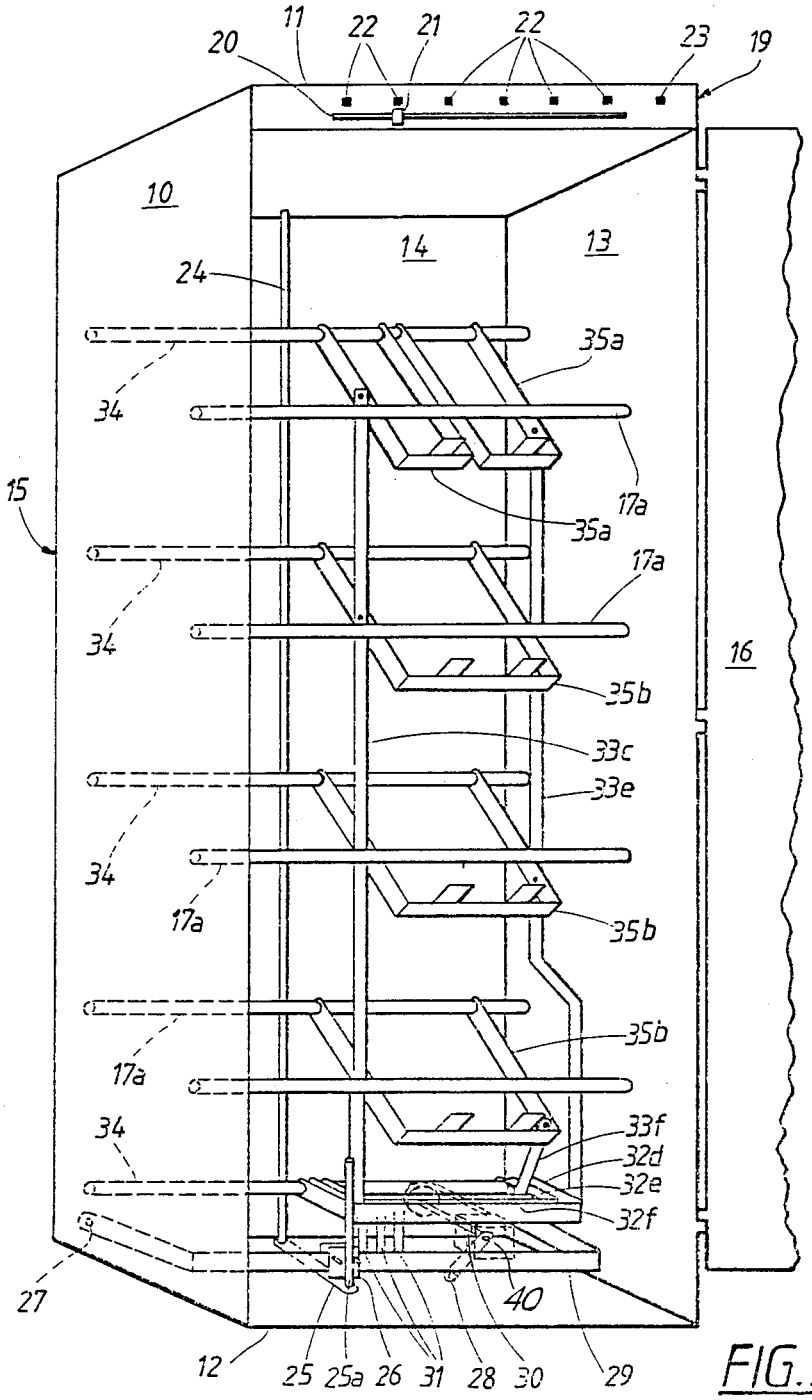
FIG.2 is a perspective view, schematically showing the feeding out means.

The control arm 21 is connected to a rotatable journalled shaft (see FIG. 2), which runs down to the lower part of the closet 15 and is provided an L-shaped arm 25. The free leg **25*a* of this arm points vertically upwards and cooperates with a traveller 26, which can be displaced along a U-shaped arm 29, which is journalled on a horizontal shaft 27 and can pivot by means of a crank shaft 28. The crank shaft 28 is mounted on a shaft 30 which extends into the closet and is rotatable through the action of an electric motor 40, which is mounted at the outside of the closet. Thus the traveller 26 can be placed in a position in which it via protruding fingers 31 cooperates with one of several coaxially journalled elevator frames 32*a*–32*f***. For greater visibility, FIG. 2 only discloses the right half of the feeding out mechanism in the closet.

Each compartment 17 is supported partly on the shafts 34 and partly on a horizontal rod **17*a***, at such an angle that the packages can slide by the force of gravitation towards the closet opening.

The elevator frames are mechanically connected via linkage arms **33*a*–33*f* to different, at each compartment level pivotally arranged feeding out means 35*a* and 35*b* which are journalled on horizontal shafts 34. The first of said feeding out means 35*a* are arranged for feeding out one package 18*g*, while the latter of said feeding out means are arranged for feeding out two packages 18*a*–18*f* and 18*i*–18*g*, If, for example, the desired meal is pea soup with pancakes, the control arm 21 is moved to the extreme right end position, wherein the traveller 26 is aligned with the elevator finger 31 which points down from the elevator frame 32***f*, and the indicator lamp 23 lights up. The fee for the meal is paid via means which are well known in this technical field and do not need any further explanation here. Then the electric motor is started so that the crank shaft 28 is rotated and the U-shaped arm 29 is moved upwards and then down to its original position. Said arm acts on the elevator frame 32*f* which is connected to the feeding out means 35*b* via the linkage arm 33*f*. The resulting movement lifts both packages 18*i* and 18*j* simultaneously out of their respective compartments 17, so that they fall downward into a feeding out chute which is not shown in the drawings but is arranged at the closet door 16, and the packages will be available to the customer. Micro switches, also not shown in the drawings, are arranged for detection of the completion of the feeding out, and for switching the electric motor off, when the U-shaped arm 29 is returned to its normal idle position.

Other meals can be fed out in the same manner, said meals comprising three packages, when any one of the elevator frames 32*b*–32*e* is selected, whereas the linkage arms 33*b*–33*e* are connected both to a feeding out means 35*a* and a feeding out means 35*b*.

The invention has been described with reference to a preferred embodiment. However, several modifications can be made without deviating from the scope of the accompanying claims. For example, the number of compartments can be altered, both vertically and horizontally. The feeding out means can be designed differently than shown.

I claim:

1. A vending machine which, after payment of a fee, delivers a complete meal from a number of meals each comprising two or more articles of food packaged in separate units which are stored in different compartments in said machine, said compartments being placed on different levels within the machine, said machine comprising selector means which is manipulable to make the meals available and comprises a traveller, a U-shaped arm along which said traveller is displaceable, said U-shaped arm being journalled on a horizontal axis, drive means for pivotting said U-shaped arm, a plurality of elevator frames coaxially journalled, said U-shaped arm being pivotted by said drive means until said traveller is in a position to cooperate with one of said elevator frames, different feeding out means arranged at each respective compartment level, and means for mechanical connection of said elevator frames to said different feeding out means.

2. A vending machine according to claim 1, wherein a linkage is provided to connect each elevator frame in parallel to at least one feeding out means.

3. A vending machine according to claims 1 or 2, wherein said machine comprises four sides walls together with a back side wall to form a vertical closet surrounding said compartments, and a closet door pivotally hinged at one of the side walls for closing off the interior of said closet, and wherein the U-shaped arm and the elevator frames are pivotally journalled between two of the vertical side walls.

4. A vending machine according to claim 3, wherein said drive means are placed in an enclosed space at the outside of said closet and has a drive shaft by means of which said drive means projects into the closet and a crankshaft provided on said drive shaft which is arranged to cooperate with said U-shaped arm during a feeding out process.

* * * * *